US008756925B2

(12) United States Patent
Sasajima et al.

(10) Patent No.: US 8,756,925 B2
(45) Date of Patent: Jun. 24, 2014

(54) EXHAUST PIPE

(75) Inventors: Takashi Sasajima, Shizuoka-ken (JP); Hideo Yamashita, Susono (JP); Daisaku Sawada, Gotemba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 320 days.

(21) Appl. No.: 13/333,678

(22) Filed: Dec. 21, 2011

(65) Prior Publication Data

US 2012/0159936 A1 Jun. 28, 2012

(30) Foreign Application Priority Data

Dec. 27, 2010 (JP) ..... 2010-290944

(51) Int. Cl.
*F01N 3/10* (2006.01)

(52) U.S. Cl.
USPC ..... 60/300; 138/39; 138/112

(58) Field of Classification Search
USPC ..... 60/300; 138/39, 112
See application file for complete search history.

(56) References Cited

U.S. PATENT DOCUMENTS

| | | | | |
|---|---|---|---|---|
| 6,305,429 | B1 * | 10/2001 | Welch et al. | 138/149 |
| 6,395,651 | B1 | 5/2002 | Smith et al. | |
| 7,578,315 | B2 * | 8/2009 | Wilson | 138/149 |
| 2006/0272727 | A1 * | 12/2006 | Dinon et al. | 138/149 |
| 2007/0151233 | A1 | 7/2007 | Zuberi et al. | |
| 2009/0205737 | A1 * | 8/2009 | Dinon et al. | 138/149 |
| 2010/0180799 | A1 * | 7/2010 | Saiki | 106/286.3 |
| 2012/0266999 | A1 | 10/2012 | Wirth | |

FOREIGN PATENT DOCUMENTS

| | | | |
|---|---|---|---|
| DE | 3238330 | A1 | 4/1984 |
| DE | 102011007854 | A1 | 10/2012 |
| JP | 2003-286841 | A | 10/2003 |
| JP | 2010-216451 | A | 9/2010 |
| WO | WO 2012093697 | A1 * | 7/2012 |

OTHER PUBLICATIONS

Petzold: Anorganisch-nichtmetallische Werkstoffe. Leipzig: Dt. Verl. für Grundstoffindustrie, 1992. pp. 46-51. ISBN 3-342-00491-6.

* cited by examiner

*Primary Examiner* — Thomas Denion
*Assistant Examiner* — Jason Shanske
(74) *Attorney, Agent, or Firm* — Gifford, Krass, Sprinkle, Anderson & Citkowski, P.C.

(57) ABSTRACT

An exhaust pipe through which an exhaust port of an internal combustion engine and a catalyst for purifying an exhaust gas of the internal combustion engine are connected to each other includes a porous portion that is provided on at least a part of an inner peripheral face of the exhaust pipe. A thermal conductivity that the porous portion exhibits in a high temperature state where a temperature of the exhaust gas is as high as it is required to radiate a heat of the exhaust gas through the exhaust pipe is at least ten times higher than a thermal conductivity that the porous portion exhibits in a low temperature state where the temperature of the exhaust gas is as low as it is required to warm the catalyst up.

12 Claims, 9 Drawing Sheets

COMPARATIVE EXAMPLE (LOW TEMP)

EXAMPLE EMBODIMENT (LOW TEMP)

COMPARATIVE EXAMPLE (HIGH TEMP)

EXAMPLE EMBODIMENT (HIGH TEMP)

EXHAUST PIPE

CROSS-REFERENCE TO RELATED APPLICATIONS

This application claims priority to Japanese Patent Application No. 2010-290944 filed on Dec. 27, 2010, which is incorporated herein by reference in its entirety including the specification, drawings and abstract.

BACKGROUND OF THE INVENTION

1. Field of the Invention

The invention relates to an exhaust pipe, and in particular to an exhaust pipe of an internal combustion engine.

2. Description of Related Art

A catalyst for purifying (controlling) exhaust gas is provided in an exhaust passage of an internal combustion engine. The exhaust gas purification (control) function of such a catalyst can not be sufficiently used unless the temperature of the catalyst is equal to its activation temperature or higher. Thus, normally, the catalyst is warmed up using the heat of exhaust gas until the temperature of the catalyst reaches the activation temperature or higher. To accelerate the warming-up of the catalyst, the temperature of exhaust gas is increased by reducing the heat loss of an exhaust pipe. For example, Japanese Patent Application Publication No. 2003-286841 describes a technology in which a double pipe is used as an exhaust pipe to reduce the radiation of heat of exhaust gas flowing in the exhaust pipe and thereby increase the exhaust gas temperature.

According to the technology described in Japanese Patent Application Publication No. 2003-286841, however, there is a possibility that the catalyst may be excessively heated due to the exhaust gas heat when the exhaust gas temperature is sufficiently high after the catalyst has been warmed up, and this may cause degradation of the exhaust gas purification (control) performance of the catalyst.

SUMMARY OF THE INVENTION

The invention provides an exhaust pipe that is capable of promoting warming-up of a catalyst, and is capable of restricting the catalyst from being excessively heated when the exhaust gas temperature is high.

The first aspect of the invention relates to an exhaust pipe. An exhaust port of an internal combustion engine and a catalyst for purifying an exhaust gas of the internal combustion engine are connected to each other through the exhaust pipe. The exhaust pipe has a porous portion that is provided on at least a part of an inner peripheral face of the exhaust pipe. A thermal conductivity that the porous portion exhibits in a high temperature state where a temperature of the exhaust gas is as high as it is required to radiate a heat of the exhaust gas through the exhaust pipe is at least ten times higher than a thermal conductivity that the porous portion exhibits in a low temperature state where the temperature of the exhaust gas is as low as it is required to warm the catalyst up.

According to the first aspect of the invention, when the exhaust gas temperature is low, the porous portion reduces the heat conduction through it, thus suppressing radiation, through the exhaust pipe, of the heat of the exhaust gas in the exhaust pipe. As such, the warming-up of the catalyst can be promoted. When the exhaust gas temperature is high, on the other hand, the porous portion enhances the heat conduction through it, thereby restricting the catalyst from being heated excessively.

The exhaust pipe of the first aspect of the invention may be such that a porosity of the porous portion is set such that the thermal conductivity of the porous portion in the high temperature state is at least ten times higher than the thermal conductivity of the porous portion in the low temperature state. According to this structure, the thermal conductivity of the porous portion in the high temperature state can be easily made at least ten times higher than the thermal conductivity of the porous portion in the low temperature state, as compared to the case where a desired thermal conductivity of the porous portion is achieved by adjusting an element(s) other than the porosity of the porous portion.

Further, in this structure, a cooler that cools a portion, at which the porous portion is provided, of a wall of the exhaust pipe may be provided. According to this structure, when the exhaust gas temperature is high and therefore the porous portion enhances the heat conduction through it, the heat of exhaust gas in the exhaust pipe can be conducted away through the porous portion and the wall of the exhaust pipe that is cooled by the cooler. Thus, the catalyst can be more effectively restricted from being heated excessively. Further, since the porous portion reduces the heat conduction through it when the exhaust gas temperature is low, even if the wall of the exhaust pipe is cooled by the cooler when the exhaust gas temperature is low, the radiation of the exhaust gas heat is suppressed by the porous portion, and thus the warming-up of the catalyst is not impeded.

Further, in this structure, a controller that controls the cooler based on the temperature of the wall may be provided. According to this structure, the temperature of the wall can be more accurately adjusted. Further, in this structure, the controller may be adapted to control the cooler so as to bring the temperature of the wall to an activation temperature of the catalyst or lower.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
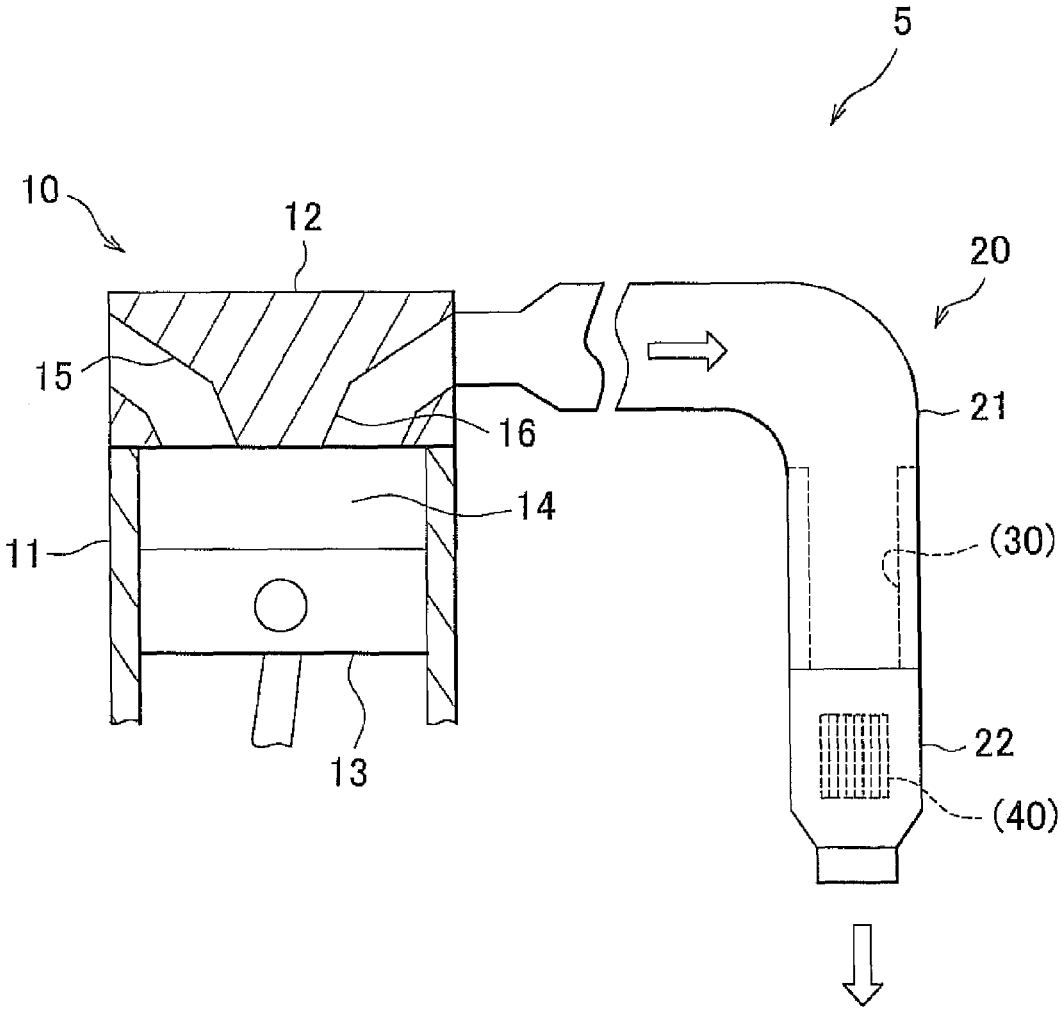
FIG. 1 is a view schematically showing the internal combustion engine system incorporating the exhaust pipe of the first example embodiment of the invention.

First, an exhaust pipe of the first example embodiment of the invention will be described. In the following, an internal combustion engine system 5 incorporating the exhaust pipe of the first example embodiment will be first described, and then the exhaust pipe will be described. FIG. 1 schematically shows the internal combustion engine system 5. Referring to FIG. 1, the internal combustion engine system 5 has an internal combustion engine 10, an exhaust pipe 20 connected to the internal combustion engine 10, and a catalyst 40 for purifying (controlling) the exhaust gas from the internal combustion engine 10.

The internal combustion engine 10 may be of any type. For example, it may be a gasoline engine, diesel engine, or the like. The internal combustion engine 10 is provided with a cylinder block 11, a cylinder head 12 mounted on the cylinder block 11, and pistons 13 disposed in the cylinder block 11. In the internal combustion engine 10, the cylinder block 11, the cylinder head 12, and the respective pistons 13 define combustion chambers 14. Intake ports 15 through which intake air is drawn into the respective combustion chambers 14 and exhaust ports 16 through which exhaust gas is discharged from the respective combustion chambers 14 are formed in the cylinder block 11.

The exhaust pipe 20 serves as a passage through which to discharge the exhaust gas of the internal combustion engine 10 to the outside of the internal combustion engine system 5. The upstream end of the exhaust pipe 20 is connected to the exhaust ports 16 of the internal combustion engine 10. The exhaust pipe 20 may be, for example, a metallic pipe. A porous portion 30 is provided between the exhaust ports 16 and the catalyst 40 in the exhaust pipe 20. The porous portion 30 has a number of pores. The material of the porous portion 30 is not limited to any specific material. In the first example embodiment, by way of example, the porous portion 30 is made of amorphous silica as the main component. The porous portion 30 will be described in more detail later. The porous portion 30 may be made of the amorphous.

In the first example embodiment, the exhaust pipe 20 has a first exhaust pipe 21 and a second exhaust pipe 22 that are connected to each other. The upstream end of the first exhaust pipe 21 is connected to the exhaust ports 16, and the upstream end of the second exhaust pipe 22 is connected to the downstream end of the first exhaust pipe 21. The porous portion 30 is provided in the first exhaust pipe 21, and the catalyst 40 is provided in the second exhaust pipe 22. It is to be noted that the porous portion 30 may be provided near or in proximity of the catalyst 40.

According to the structure described above, for example, the exhaust pipe 20 may be manufactured by setting the porous portion 30 in the first exhaust pipe 21, then setting the catalyst 40 in the second exhaust pipe 22, and then connecting the first exhaust pipe 21 and the second exhaust pipe 22 to each other. As such, the exhaust pipe 20 is constituted of the first exhaust pipe 21 and the second exhaust pipe 22 that are connected to each other, and therefore the exhaust pipe 20 in which the porous portion 30 and the catalyst 40 are provided can be easily manufactured.

In the meantime, the connection between the first exhaust pipe 21 and the second exhaust pipe 22 is not limited to any specific connection form or structure. For example, the first exhaust pipe 21 and the second exhaust pipe 22 may be connected using various known joints used for connecting two pipes or pipe-like members, such as flange joint and welded joint. Further, the structure of the exhaust pipe 20 is not limited to such a combination of the first exhaust pipe 21 and the second exhaust pipe 22 that are connected to each other. For example the exhaust pipe 20 may alternatively be a single exhaust pipe.

Any catalyst may be used as the catalyst 40 as long as it is capable of purifying (controlling) the exhaust gas as needed. For example, a three-way catalyst, or the like, may be used as the catalyst 40. The position of the catalyst 40 is not specifically limited. In the first example embodiment, by way of example, the catalyst 40 is arranged at the radially center portion of the interior of the second exhaust pipe 22 (i.e., a region having a specific volume and centered at the axis of the second exhaust pipe 22).

Figure 2:
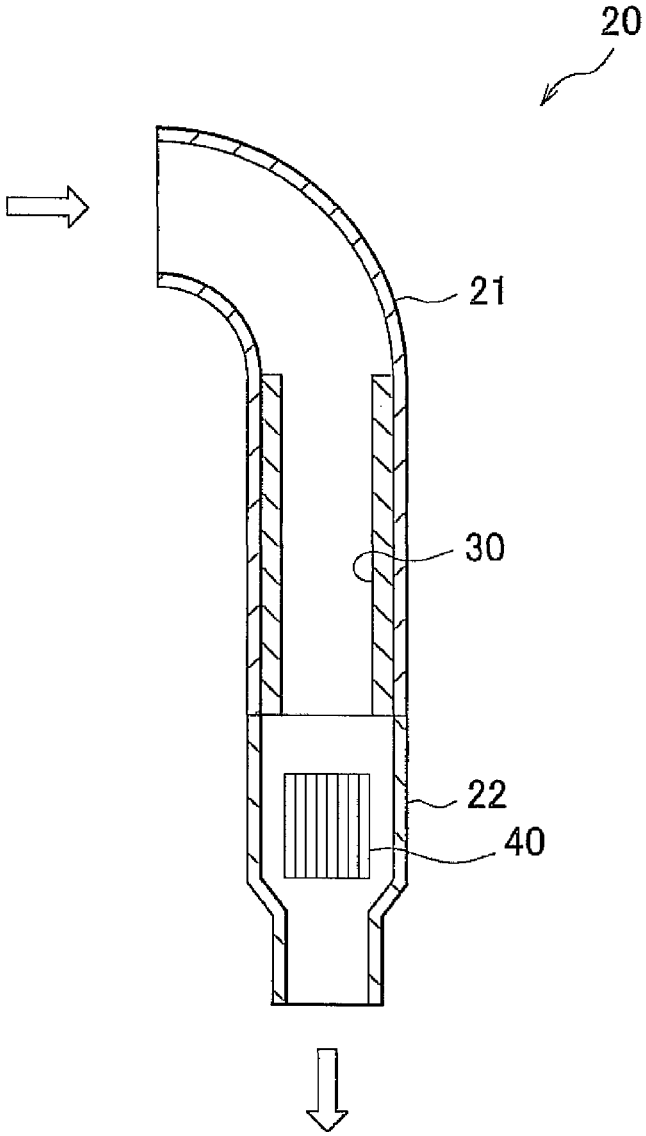
FIG. 2 is a sectional view showing a part of the exhaust pipe of the first example embodiment.

FIG. 2 is a sectional view schematically showing a part of the exhaust pipe 20. In the first example embodiment, the porous portion 30 is provided on a part of the inner peripheral face of the first exhaust pipe 21. More specifically, the porous portion 30 is provided as a coating on the entirety of the region from the downstream end of the first exhaust pipe 21 to a bending portion (the portion bending at 90 degrees, shown in FIG. 2) of the first exhaust pipe 21. It is to be noted that the arrangement of the porous portion 30 is not limited to this. For example, the porous portion 30 may be provided on the entire inner peripheral face of the exhaust pipe 20. That is, it would suffice if the porous portion 30 is provided on at least a part of the inner peripheral face of the exhaust pipe 20.

Meanwhile, referring to FIG. 2, the porous portion 30 is arranged along the inner peripheral face so as not to occupy the radially center area in the first exhaust pipe 21. However, it is to be noted that the porous portion 30 may be arranged otherwise. For example, the porous portion 30 may alternatively be arranged to occupy also the radially center area in the first exhaust pipe 21. In this case, for example, the porous portion 30 is arranged to occupy the entire area from the downstream end of the first exhaust pipe 21 to the bending portion. However, arranging the porous portion 30 along the inner peripheral face of the exhaust pipe 20 so as not to occupy the radially center area in the exhaust pipe 20 as shown in FIG. 2 minimizes the possibility of impediment of the exhaust gas flow from the exhaust ports 16 to the catalyst 40.

Next, the structure of the porous portion 30 will be described in detail. However, before that, the reason why the exhaust pipe 20 has the porous portion 30 will be first explained in detail. The catalyst 40 is not sufficiently active until it is heated up to a given activation temperature or higher. If the catalyst 40 is not sufficiently active, its exhaust gas purification (control) function can not be sufficiently used, possibly failing to reduce the emissions as needed. Thus, required is a process for warming (heating) the catalyst 40 up to the activation temperature or higher (i.e., the catalyst 40 needs to be warmed up). The catalyst 40 is warmed up using the heat of exhaust gas.

Meanwhile, when heated up to a certain temperature (will hereinafter be referred to as "upper limit temperature") or higher, the exhaust gas purification (control) performance of the catalyst 40 becomes low. Thus, in order to restrict the catalyst 40 from being heated up to the upper limit temperature or higher by the exhaust gas heat, it is necessary or desirable to suppress an increase in the exhaust gas temperature by enhancing the exhaust gas heat radiation through the exhaust pipe 20 when the exhaust gas temperature is high after the warming-up of the catalyst 40.

Figure 3A:
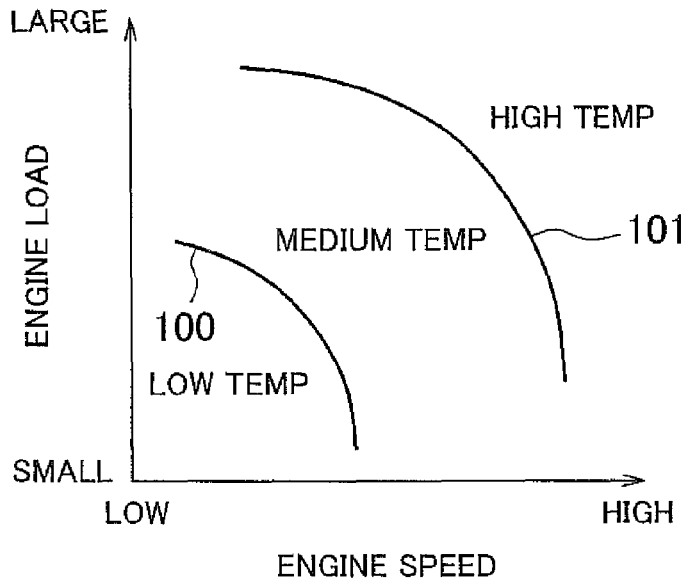
FIG. 3A is a graph illustrating a relation between the operation state of the internal combustion engine and the exhaust gas temperature.

The graph of FIG. 3A illustrates a relation between the operation state of the internal combustion engine 10 and the exhaust gas temperature. The horizontal axis of the graph represents the speed of the internal combustion engine 10, while the vertical axis represents the load on the internal combustion engine 10. Curves 100 and 101 in FIG. 3A are level curves of the exhaust gas temperature. The curve 100 represents the activation temperature of the catalyst 40, which is, for example, 400° C. or higher, while the curve 101 represents the upper limit temperature of the catalyst 40, which is, for example, 900° C. or higher.

FIG. 3A shows three divisional exhaust gas temperature regions, that is, a low temperature region, a medium temperature region, and a high temperature region, which are set in association with the operation state of the internal combustion engine 10. More specifically, the low temperature region is of exhaust gas temperatures lower than the curve 100, the high temperature region is of exhaust gas temperatures higher than the curve 101, and the medium temperature region is of exhaust gas temperatures from the curve 100 to the curve 101.

The low temperature region is the region where the catalyst 40 is required to be warmed up. When the exhaust gas temperature is in the low temperature region, the warming-up of the catalyst 40 is promoted by suppressing the exhaust gas heat radiation through the exhaust pipe 20. That is, the low temperature region can be also deemed as the region where the exhaust gas heat radiation through the exhaust pipe 20 is required to be suppressed. The high temperature region, on the other hand, is the region where the exhaust gas heat is required to be radiated through the exhaust pipe 20. When the exhaust gas temperature is in the high temperature region, in order to restrict degradation of the exhaust gas purification (control) performance of the catalyst 40, the catalyst 40 is restricted from being heated up to the upper limit temperature or higher by promoting the exhaust gas heat radiation through the exhaust pipe 20. It is to be noted that the high temperature region also includes temperatures close to the upper limit value.

However, it is not easy to achieve both the promotion of warming-up of the catalyst 40 during the exhaust gas temperature being low and the restriction of excessive heating of the catalyst 40 during the exhaust gas temperature being high. For example, the warming-up of the catalyst 40 can be promoted by providing a thermal insulator in the exhaust pipe 20. This, however, increases the possibility that the exhaust gas temperature rise up to the upper limit temperature or higher after the warming-up of the catalyst 40. As such, the catalyst 40 is more likely to be heated up to the upper limit temperature or higher, that is, the possibility of degradation of the exhaust gas purification (control) performance of the catalyst 40 increases. To counter this, in the first example embodiment, the porous portion 30 is provided in the exhaust pipe 20 to achieve both the promotion of warming-up of the catalyst 40 during the exhaust gas temperature being low and the restriction of excessive heating of the catalyst 40 during the exhaust gas temperature being high.

Figure 3B:
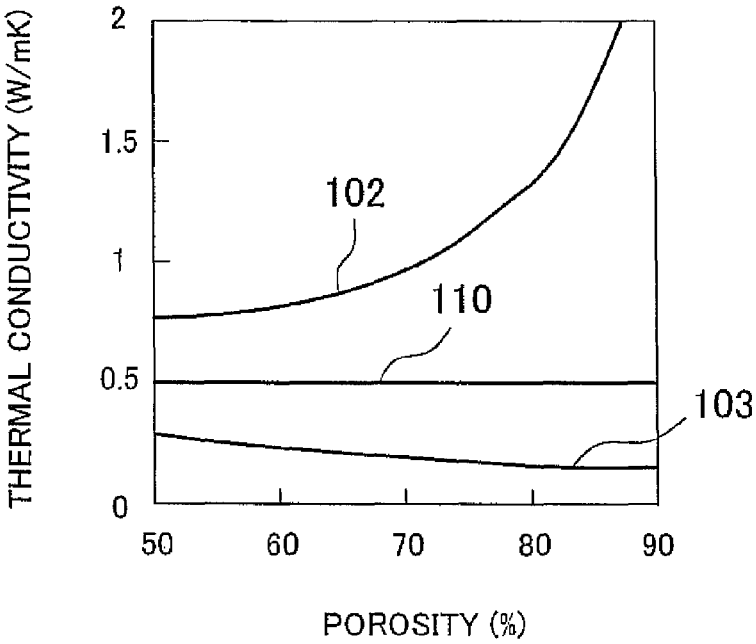
FIG. 3B is a graph illustrating the thermal conductivity characteristic of the porous portion.

Next, the thermal conductivity characteristic of the porous portion 30 will be described. The graph in FIG. 3B illustrates the thermal conductivity characteristic of the porous portion 30. The horizontal axis of the graph represents the porosity (%) of the porous portion 30, while the vertical axis represents the thermal conductivity (W/mK) of the porous portion 30. Note that "porosity" represents the ratio of the pores of the porous portion 30. In the graph, a straight line 110 represents the thermal conductivity of the material of the porous portion 30, which is amorphous silica, for example. Curves 102 and 103 each represent a thermal conductivity of the porous portion 30. More specifically, the curve 102 represents the thermal conductivity that the porous portion 30 exhibits when the exhaust gas temperature is high, while the curve 103 represents the thermal conductivity that the porous portion 30 exhibits when the exhaust gas temperature is low.

The equations (1) and (2) shown below are Hazen-Williams' equations used for calculating the thermal conductivities represented by the curves 102 and 103.

$$\lambda=(1-\Phi)\times\lambda_s+\Phi+\lambda_g+(1-\Phi)^{-1}\times\lambda_r \quad (1)$$

$$\lambda_r=16\sigma\times T^3/(3K_e) \quad (2)$$

In the equations (1) and (2), $\lambda$ represents the thermal conductivity of the porous portion 30, and $\lambda_s$ represents the thermal conductivity of the material of the porous portion 30. In the example illustrated in FIG. 3B, $\lambda_s$ is 0.5, and thus the value of the straight line 110 is 0.5. Further, $\lambda_g$ represents the thermal conductivity of the internal gas, $\lambda_r$ represents the thermal conductivity of radiation, $\Phi$ represents the porosity of the porous portion 30, $\sigma$ is a Stefan-Boltzmann constant, $K_e$ is a radiation-absorption coefficient, and T represents a temperature. The temperature T was set, by way of example, to 1200 K for the curve 102, and 400 K for the curve 103.

As is evident from FIG. 3B, the thermal conductivity of the porous portion 30 is higher than the thermal conductivity of the material of the porous portion 30 (the straight line 110) when the exhaust gas temperature is high (the curve 102), while the thermal conductivity of the porous portion 30 is lower than the thermal conductivity of the material of the porous portion 30 (the straight line 110) when the exhaust gas temperature is low (the curve 103). As the reason of this, it is believed that the radiation largely affects the thermal conductivity when the exhaust gas temperature is high, while the gas in the pores of the porous portion 30 largely affects the thermal conductivity when the exhaust gas temperature is low.

That is, comparing the thermal conductivity of the porous portion 30 with that of the material of the porous portion 30, it is found that the thermal conductivity of the porous portion 30 is lower than that of the material of the porous portion 30 when the exhaust gas temperature is low, while the thermal conductivity of the porous portion 30 is higher than that of the material of the porous portion 30 when the exhaust gas temperature is high. As such, if the porous portion 30 is provided on the inner peripheral face of the exhaust pipe 20, the porous portion 30 serves as a member or portion for reducing the heat conduction when the exhaust gas temperature is low, and serves as a member or portion for enhancing the heat conduction when the exhaust gas temperature is high.

Next, the thermal conductivity of the porous portion 30 will be described. More specifically, in the following, a description will be made of, by way of example, a preferred thermal conductivity of the porous portion 30 for achieving both the promotion of warming-up of the catalyst 40 during the exhaust gas temperature being low and the restriction of excessive heating of the catalyst 40 during the exhaust gas temperature being high.

First, a relation between the exhaust gas temperature and the flux of heat traveling from the exhaust gas in the exhaust pipe 20 to the wall of the exhaust pipe 20 will be described. Table 1 shown below represents the relation between the exhaust gas temperature and the heat flux. In Table 1, the unit of the temperature is ° C., the unit of the thermal transfer coefficient is $W/m^2K$, and the unit of the heat flux is $kW/m^2$. In the example illustrated in Table 1, the heat flux in the low temperature region was calculated, by way of example, on the assumption that the exhaust gas temperature is 400° C., which is the example activation temperature of the catalyst 40, the wall temperature of the exhaust pipe 20 is 100° C., and the heat transfer coefficient of exhaust gas is 50 $W/m^2K$. In the example illustrated in Table 1, the heat flux in the high temperature region was calculated, by way of example, on the assumption that the exhaust gas temperature is 900° C., which is the example upper limit temperature of the catalyst 40, the wall temperature of the exhaust pipe 20 is 100° C., and the heat transfer coefficient of exhaust gas is 250 $W/m^2K$.

TABLE 1

| | Low temperature region | High temperature region |
|---|---|---|
| A-B | 400-100 | 900-100 |
| Heat transfer coefficient | 50 | 250 |
| Heat flux | 15 | 200 |

A: Exhaust gas temperature
B: Wall temperature

As is evident from Table 1, the heat flux achieved when the exhaust gas temperature is in the high temperature region is 200 $kW/M^2$, that is, at least ten times larger than the heat flux achieved when the exhaust gas temperature is in the low temperature region (15 $kW/M^2$). This shows that in order to keep the temperature of the catalyst 40 lower than the upper limit temperature when the exhaust gas temperature is high, preferably, the thermal conductivity that the porous portion 30 exhibits when the exhaust gas temperature is high is high enough to conduct a heat flux at least ten times larger than the heat flux conducted when the exhaust gas temperature is low.

In view of the above, in the first example embodiment, the thermal conductivity of the porous portion 30 is set such that the thermal conductivity that the porous portion 30 exhibits when the exhaust gas temperature is high is at least ten times higher than the thermal conductivity that the porous portion 30 exhibits when the exhaust gas temperature is low. Accordingly, when the exhaust gas temperature is high after the warming-up of the catalyst 40, the porous portion 30 enhances the heat conduction through it, restricting the exhaust gas temperature from reaching the upper limit temperature of the catalyst 40 or higher. As such, the catalyst 40 can be restricted from being heated up to the upper limit temperature or higher. On the other hand, when the exhaust gas temperature is low, the porous portion 30 reduces the heat conduction through it, allowing the catalyst 40 to be quickly heated up to the activation temperature or higher.

Next, a method for setting the thermal conductivity of the porous portion 30 will be described. As is evident from FIG. 3B, the thermal conductivity of the porous portion 30 largely changes depending upon the porosity of the porous portion 30. More specifically, the curve 102 starts to rise sharply from directly after approximately 60%. As a result, the value of the curve 102 is at least ten times larger than the value of the curve 103 when the porosity is approximately 85%. As such, the thermal conductivity that the porous portion 30 exhibits when the exhaust gas temperature is high can be made at least ten times higher than the thermal conductivity that the porous portion 30 exhibits when the exhaust gas temperature is low, by setting the porosity of the porous portion 30 to a target value.

The target value of the porosity of the porous portion 30, for example, can be calculated using the equations (1) and (2) described earlier. Described in the following is an example case where such a target value of the porosity of the porous portion 30 is calculated using the equations (1) and (2) on the assumption that the temperature of the low temperature exhaust gas is 400 K and the temperature of the high temperature exhaust gas is 1200 K. The thermal conductivity $\lambda_1$ of the porous portion 30 during the exhaust gas temperature being low (T=400 K) is expressed by the following equation (3), which is obtained from the equations (1) and (2).

$$\lambda_1=\lambda_s\times(1-\Phi)+19/((1-\Phi)\times K_e) \quad (3)$$

On the other hand, the thermal conductivity $\lambda_2$ of the porous portion 30 during the exhaust gas temperature being high (T=1200 K) is expressed by the following equation (4), which is obtained from the equations (1) and (2).

$$\lambda_2=\lambda_s\times(1-\Phi)+420/((1-\Phi))\times K_e) \quad (4)$$

Meanwhile, the following equation (5) needs to be satisfied to make the thermal conductivity $\lambda_2$ at least ten times higher than the thermal conductivity $\lambda_1$.

$$\lambda_1/\lambda_2=(\lambda_s\lambda(1-\Phi)^2+420/K_e)/(\lambda_s\times(1-\Phi)^2+19/K_e)\geq 10 \quad (5)$$

The porosity $\Phi$ for satisfying the equation (5) above is only required to satisfy the equation (6) below.

$$\Phi\geq 1-(25/(\lambda_s\times K_e))^{1/2} \quad (6)$$

Thus, by calculating the porosity $\Phi$ using the equation (6) above, it is possible to calculate the porosity with which the thermal conductivity of the porous portion 30 during the exhaust gas temperature being high is at least ten times higher than the thermal conductivity of the porous portion 30 during the exhaust gas temperature being low. For example, in a case where the porous portion 30 is made of amorphous silica as the main component, $\lambda_s$ is 1.38 W/mK, and $K_c$ is 2100 $m^{-1}$, and therefore the equation (6) gives the porosity $\Phi$ of 0.9 or more ($\Phi\geq 0.9$). That is, in a case where the porous portion 30 is made of amorphous silica as the main component, the thermal conductivity of the porous portion 30 during the exhaust gas temperature being high is at least ten times higher than the thermal conductivity of the porous portion 30 during the exhaust gas temperature being low, if the porosity of the porous portion 30 is 90% or more.

According to the exhaust pipe 20 of the first example embodiment, as described above, the porous portion 30 is provided on at least a part of the inner peripheral face of the exhaust pipe 20 through which the exhaust ports 16 of the internal combustion engine 10 and the catalyst 40 are connected to each other, and the thermal conductivity of the porous portion 30 during the exhaust gas temperature being high is at least ten times higher than the thermal conductivity of the porous portion 30 during the exhaust gas temperature being low. As such, when the exhaust gas temperature is low, the porous portion 30 reduces the heat conduction through it, suppressing the radiation of the exhaust gas heat through the exhaust pipe 20, and thus promoting the warming-up of the catalyst 40. When the exhaust gas temperature is high, on the other hand, the porous portion 30 enhances the heat conduction through it, restricting the catalyst 40 from being heated excessively. More specifically, since the thermal conductivity of the porous portion 30 during the exhaust gas temperature being high is at least ten times higher than the thermal conductivity of the porous portion 30 during the exhaust gas temperature being low, the exhaust gas temperature is restricted from rising up to the upper limit temperature of the catalyst 40 or higher, and thus the catalyst 40 is restricted from being heated up to the upper limit temperature or higher. Accordingly, degradation of the exhaust gas purification (control) performance of the catalyst 40 can be restricted.

According to the exhaust pipe 20 of the first example embodiment, further, the thermal conductivity of the porous portion 30 during the exhaust gas temperature being high is made at least ten times higher than the thermal conductivity of the porous portion 30 during the exhaust gas temperature being low, by setting the porosity of the porous portion 30 to the target value. Thus, the thermal conductivity of the porous portion 30 during the exhaust gas temperature being high can be easily made at least ten times higher than the thermal conductivity of the porous portion 30 during the exhaust gas temperature being low, as compared to the case where a desired thermal conductivity of the porous portion 30 is achieved by adjusting an element(s) other than the porosity of the porous portion 30.

Figure 4:
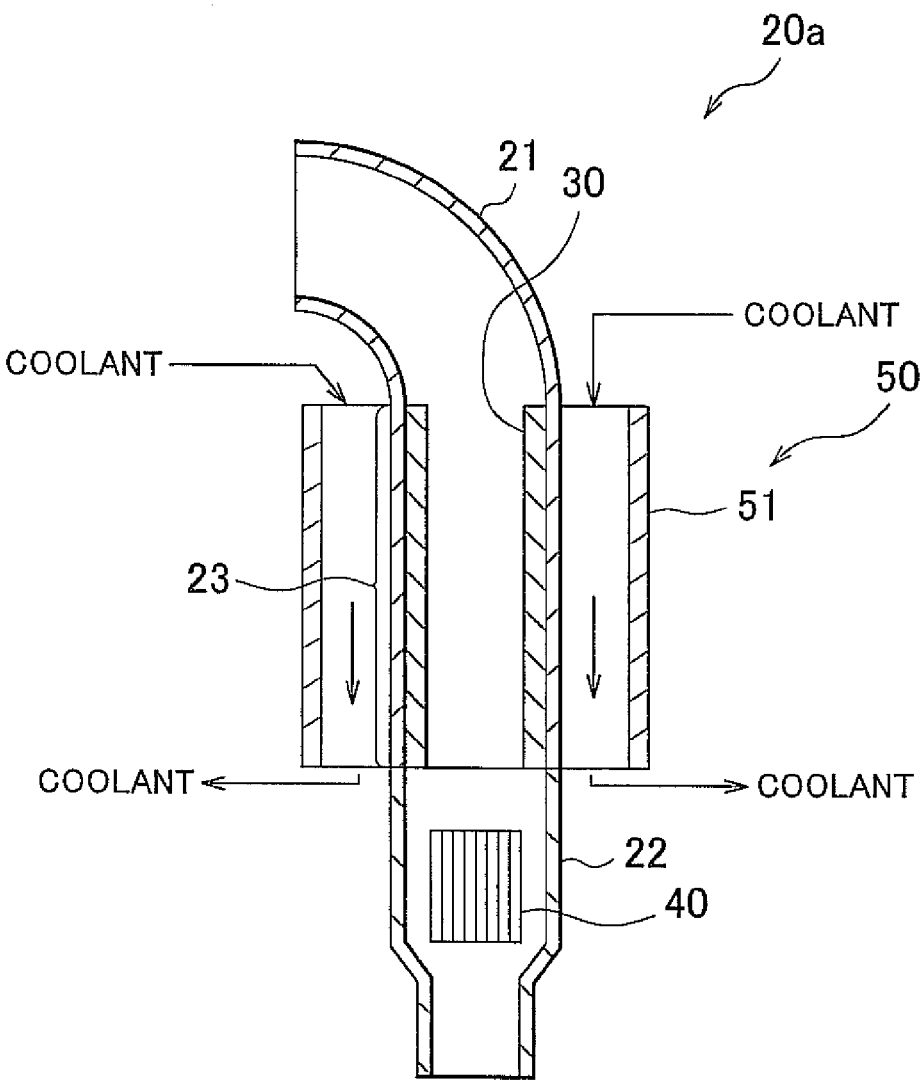
FIG. 4 is a sectional view schematically showing a part of the exhaust pipe of the second example embodiment of the invention.

Next, an exhaust pipe 20*a* of the second example embodiment of the invention will be described. FIG. 4 is a sectional view schematically showing a part of the exhaust pipe 20*a*. The exhaust pipe 20*a* is different from the exhaust pipe 20 of the first example embodiment in that it further has a cooler 50 that cools the portion of the wall of the exhaust pipe 20*a* at which the porous portion 30 is provided. Other structural features of the exhaust pipe 20*a* are the same as those of the exhaust pipe 20 of the first example embodiment, and therefore their descriptions will be omitted. It is to be noted that the portion of the exhaust pipe at which the porous portion 30 is provided will be referred to as "wall 23" where necessary.

The cooler 50 may be selected from among various types of coolers, as long as it is capable of cooling the wall 23. For example, the cooler 50 may either be a water-cooled cooler or an air-cooled cooler, or it may be a cooler combining a water-cooled cooling system and an air-cooled cooling system.

The cooler 50 shown in FIG. 4 is a water-cooled cooler. The cooler 50 has a coolant passage 51 through which to circulate the coolant. The coolant passage 51 is provided around the wall 23. More specifically, the coolant passage 51 is defined by a cylindrical pipe provided around the wall 23. Thus, the wall 23 is cooled by the coolant flowing in the coolant passage 51. That is, the coolant passage 51 and the coolant together serve as cooling means for cooling the wall 23. The coolant is delivered to the coolant passage 51 using coolant-delivering means, which is a pump, for example.

Figure 5A:
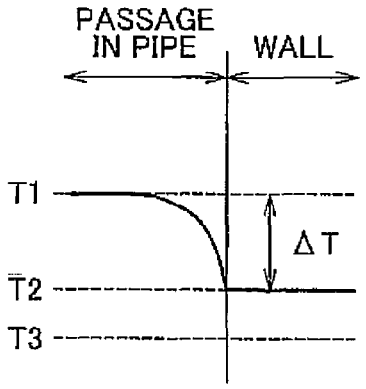
FIGS. 5A to 5D are graphs for illustrating the effect of the exhaust pipe of the second example embodiment.
Figure 5B:
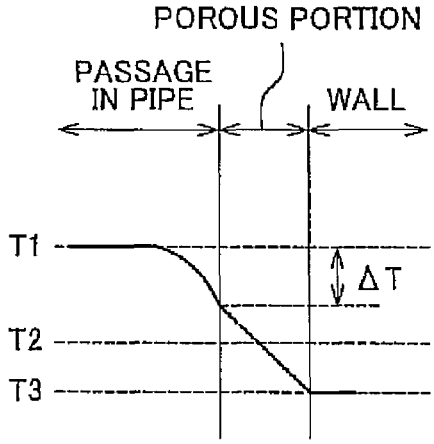

FIGS. 5A to 5D are graphs for illustrating the effect of the exhaust pipe 20*a*. Among them, FIG. 5A shows, as a comparative example, the temperature in an exhaust pipe having neither a porous portion nor a cooler (will hereinafter be referred to as "comparative example exhaust pipe"), and the temperature of a wall, corresponding to the wall 23, of the comparative example exhaust pipe in a state where the exhaust gas temperature is low. FIG. 5B shows the temperature in the exhaust pipe 20*a*, the temperature of the porous portion 30, and the temperature of the wall 23 in a state where the exhaust gas temperature is low. It is to be noted that the temperatures T1 to T3 satisfy T1>T2>T3.

Figure 5C:
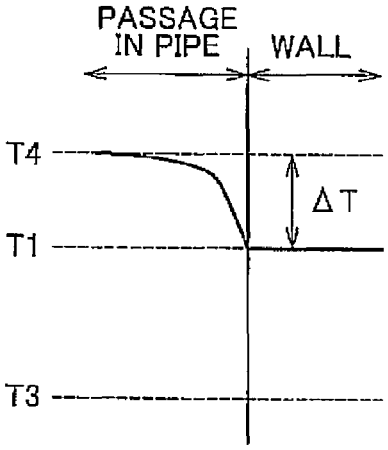
Figure 5D:
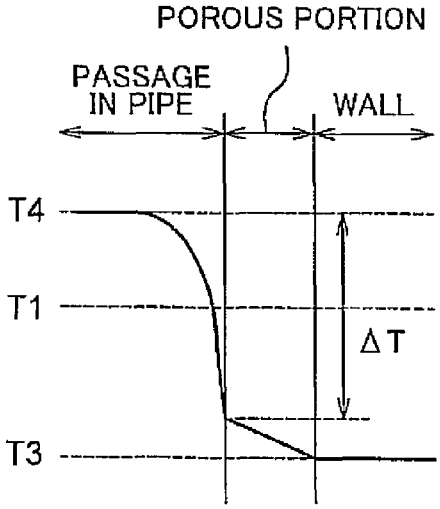

FIG. 5C shows the temperature in the comparative example exhaust pipe and the temperature of the wall of the same pipe in a state where the exhaust gas temperature is high. FIG. 5D shows the temperature in the exhaust pipe 20*a*, the temperature of the porous portion 30, and the temperature of the wall 23 in a state where the exhaust gas temperature is high. It is to be noted that the temperatures T4, T1, and T3 satisfy T4>T1>T3.

A comparison between FIGS. 5D and 5C shows that the temperature of the wall 23 of the exhaust pipe 20*a* (T3) is lower than the temperature of the wall in the comparative example (T1). This is because the exhaust pipe 20*a* is provided with the cooler 50 and the porous portion 30 and therefore the heat of exhaust gas in the exhaust pipe 20*a* is effectively conducted away via the porous portion 30 and the wall 23 cooled by the cooler 50. As a result, the radiation amount (ΔT) of the heat of exhaust gas in the exhaust pipe 20*a*, which is shown in FIG. 5D, is larger than the radiation amount (ΔT) of the heat of exhaust gas in the comparative example exhaust pipe, which is shown in FIG. 5C. As such, due to the porous portion 30 and the cooler 50, the exhaust pipe 20*a* more effectively restricts the catalyst 40 from being excessively heated when the exhaust gas temperature is high.

On the other hand, a comparison between FIGS. 5B and 5A shows that the temperature of the wall 23 of the exhaust pipe 20*a* (T3) is lower than the temperature of the wall in the comparative example (T2). However, since the exhaust pipe 20*a* has the porous portion 30 that reduces the heat conduction through it when the exhaust gas temperature is low, even if the wall 23 is cooled by the cooler 50 when the exhaust gas temperature is low, the conduction of the heat of exhaust gas in the exhaust pipe 20*a* to the wall 23 is suppressed by the porous portion 30. As a result, the radiation amount (ΔT) of the heat of exhaust gas in the exhaust pipe 20*a*, which is shown in FIG. 5B, is smaller than the radiation amount (ΔT) of the heat of exhaust gas in the comparative example exhaust pipe, which is shown in FIG. 5A. According to the exhaust pipe 20*a*, as such, even if the cooler 50 cools the wall 23 when the exhaust gas temperature is low, the radiation of exhaust gas heat is suppressed by the porous portion 30, and therefore the warming-up of the catalyst 40 is not impeded.

Accordingly, due to the porous portion 30 and the cooler 50, the exhaust pipe 20*a* of the second example embodiment is capable of promoting the warming-up of the catalyst 40 when the exhaust gas temperature is low, and is capable of more effectively restricting the catalyst 40 from being heated excessively when the exhaust gas temperature is high.

First Modification Example

Figure 6:
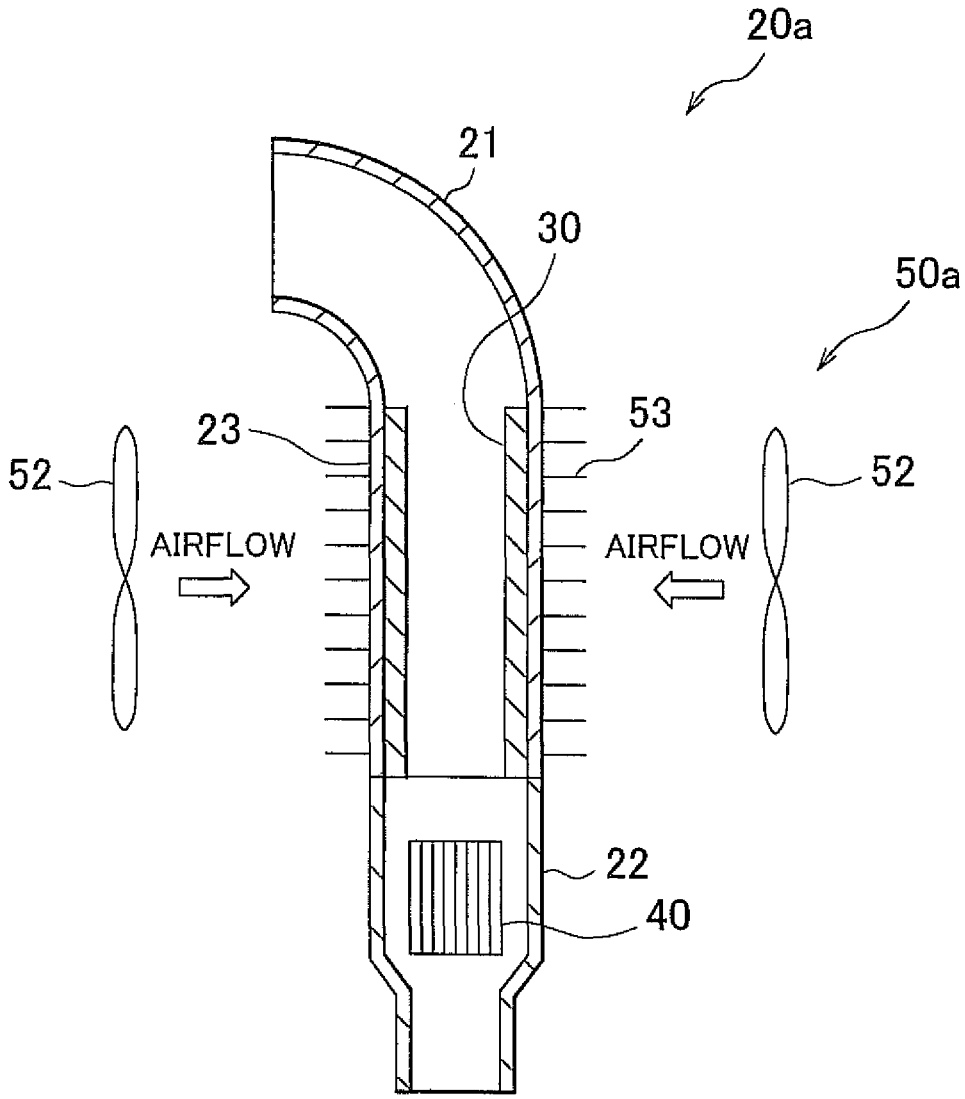
FIG. 6 is a sectional view schematically showing a part of the exhaust pipe of the first modification example of the second example embodiment.

FIG. 6 is a sectional view schematically showing a part of the exhaust pipe 20*a* according to the first modification example of the second example embodiment. The exhaust pipe 20*a* of this modification example is different from the exhaust pipe 20*a* shown in FIG. 4 in that it has an air-cooled cooler 50*a* in place of the water-cooled cooler 50. Other structural features are the same as those shown in FIG. 4, and therefore their descriptions will be omitted.

The cooler 50*a* has fans 52 and fins 53. The fans 52 blow air toward the wall 23. Thus, the wall 23 is cooled by the fans 52 blowing air. The fans 52 are two in this modification example. It is to be noted that the number of the fans 52 is not specifically limited. The first fan 52 blows air toward one side of the exhaust pipe 20*a*, while the second fan 52 blows air toward the other side of the exhaust pipe 20*a*.

The fins 53 are provided on the outer peripheral face of the wall 23 of the exhaust pipe 20*a*. The fins 53 facilitate the heat radiation from the wall 23. As such, providing the exhaust pipe 20*a* with both the fans 52 and the fins 53 achieves a higher cooling effect on the wall 23 than when the fans 52 or the fins 53 are not provided.

As well as the exhaust pipe 20*a* shown in FIG. 4, due to the porous portion 30 and the cooler 50*a*, the exhaust pipe 20*a* of this modification example is capable of promoting the warming-up of the catalyst 40 when the exhaust gas temperature is low, and is capable of more effectively restricting the catalyst 40 from being heated excessively when the exhaust gas temperature is high.

Figure 7:
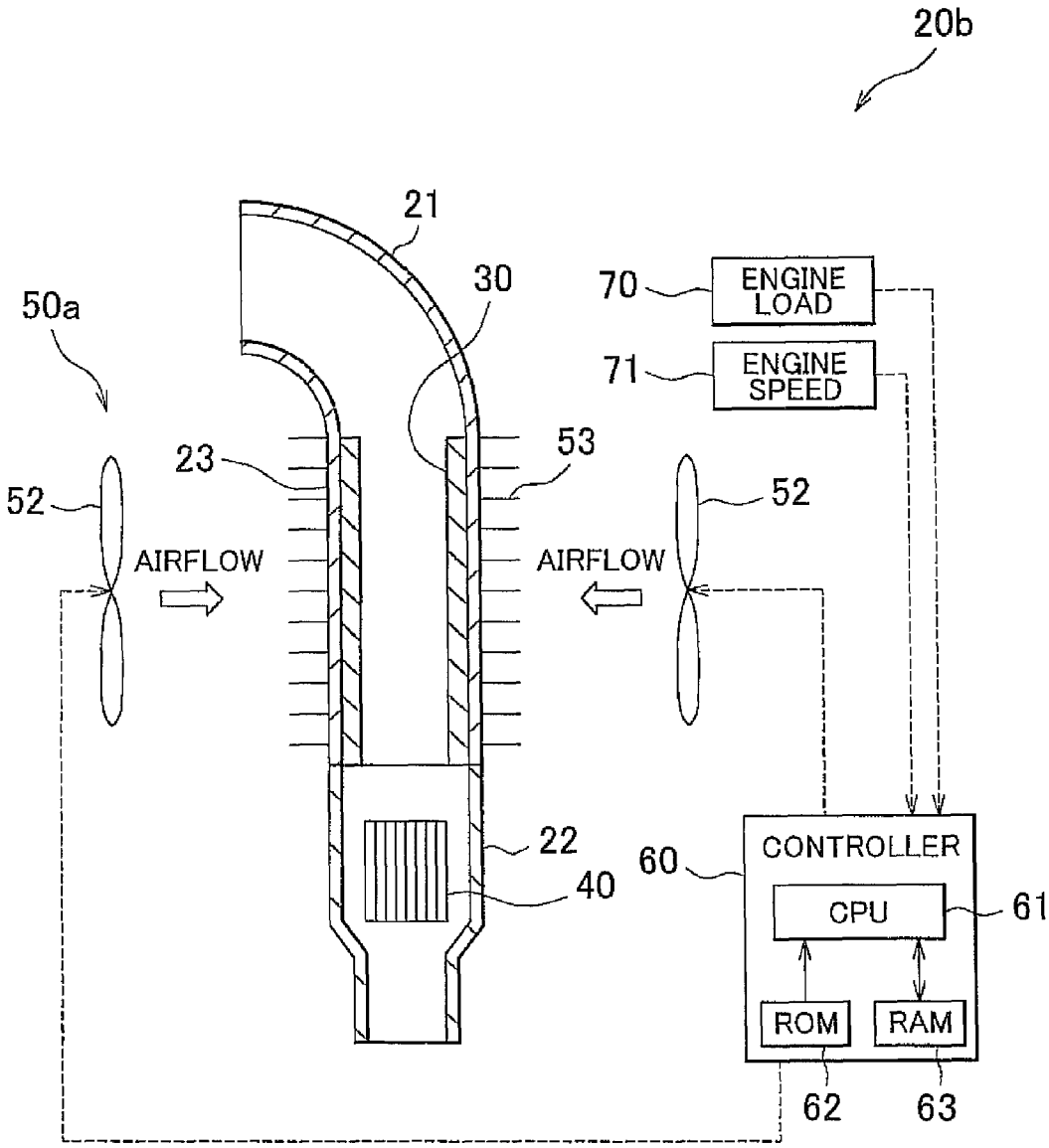
FIG. 7 is a sectional view schematically showing a part of the exhaust pipe of the third example embodiment of the invention.

Next, an exhaust pipe 20*b* of the third example embodiment of the invention will be described. FIG. 7 is a sectional view schematically showing a part of the exhaust pipe 20*b*. Referring to FIG. 7, the exhaust pipe 20*b* is different from the exhaust pipe 20*a* of the second example embodiment in that it further has a controller 60 that controls the cooler. It is to be noted that the cooler 50*a* is shown in FIG. 7 as an example of the cooler in the third example embodiment. Other structural features are the same as those in the second example embodiment, and therefore their descriptions will be omitted.

The controller 60 is a microcomputer incorporating a central processing unit (CPU) 61, a read-only memory (ROM) 62. and a random-access memory (RAM) 63. The CPU 61 operates on various programs, maps, and the like, stored in the ROM 62 while using the RAM 63 as a temporary data storage (memory); so that the cooler 50 serves as controlling means for controlling the cooler 50*a*.

More specifically, the controller 60 determines the temperature of the wall 23 and controls the cooler 50*a* based on the determined temperature of the wall 23. The method that the controller 60 uses to determine the temperature of the wall 23 is not limited specifically. The temperature of the wall 23 is correlative to the exhaust gas temperature, and the exhaust gas temperature is correlative to the operation state of the internal combustion engine 10. Therefore, for example, the controller 60 can determine the temperature of the wall 23 based on the operation state of the internal combustion engine 10. Alternatively, the temperature of the wall 23 may be determined based on the result of detection by, if any, a temperature sensor for detecting the temperature of the wall 23.

The controller 60 of the third example embodiment is adapted, by way of example, to determine the temperature of the wall 23 based on the operation state of the internal combustion engine 10. More specifically, the controller 60 determines the temperature of the wall 23 based on the load on the internal combustion engine 10 and the speed of the internal combustion engine 10. For this purpose, a result of detection by an engine load detection portion 70 that detects the load on the internal combustion engine 10 and an engine speed detection portion 71 that detects the speed of the internal combustion engine 10 are sent to the controller 60.

The load on the internal combustion engine 10 can be, for example, calculated based on the accelerator operation amount (e.g., the travel of the accelerator pedal), the fuel injection amount, and so on. Therefore, for example, the engine load detection portion 70 may be an electronic control unit (ECU) that calculates the load on the internal combustion engine 10 based on at least one of the accelerator operation amount and the fuel injection amount. The engine speed can be calculated based on the angle of the crankshaft (crank angle) of the internal combustion engine 10. Therefore, for example, the engine speed detection portion 71 may be an ECU that calculates the engine speed based on the crank angle.

Meanwhile, by way a example, a map specifying the temperature of the wall 23 in association with the load on the internal combustion engine 10 and the speed of the internal combustion engine 10 is prestored in the ROM 62 of the controller 60. In this case, the controller 60 determines the temperature of the wall 23 by applying to the map the results of detections by the engine load detection portion 70 and engine speed detection portion 71.

After determining the temperature of the wall 23, the controller 60 controls the cooler 50*a* in accordance with the determined temperature of the wall 23. In the third example embodiment, the controller 60 is adapted to control the cooler 50*a* so as to bring the temperature of the wall 23 to a predetermined temperature. More specifically, the controller 60 controls the airflow from the cooler 50*a* such that the temperature of the wall 23 becomes equal to or lower than the activation temperature of the catalyst 40.

More specifically, the controller 60 prestores therein a threshold (Tc) for the temperature of the wall 23, which is used as a reference value for determining whether to activate the fans 52 of the cooler 50*a*. The values of the threshold (Tc) prestored in the controller 60 are associated with the operation state of the internal combustion engine 10. The controller 60 determines the temperature of the wall 23 and the value of the threshold (Tc) based on the operation state of the internal combustion engine 10. If the temperature of the wall 23 is higher than the value of the threshold (Tc), the controller 60 activates the fans 52 of the cooler 50*a* to control the temperature of the wall 23 to be equal to or lower than the activation temperature of the catalyst 40. On the other hand, if the temperature of the wall 23 is equal to or lower than the value of the threshold (Tc), the controller 60 stops the fans 52 of the cooler 50*a*.

By way of example, the threshold (Tc) may be a variable with which the temperature of the catalyst 40 can be kept equal to or lower than its activation temperature by activating the fans 52 of the cooler 50*a* in response to the temperature of the wall 23 reaching the value of the threshold (Tc). The values of the threshold (Tc) may be set in advance empirically or through simulations, for example, and then stored in the ROM 62, or the like.

Figure 8:
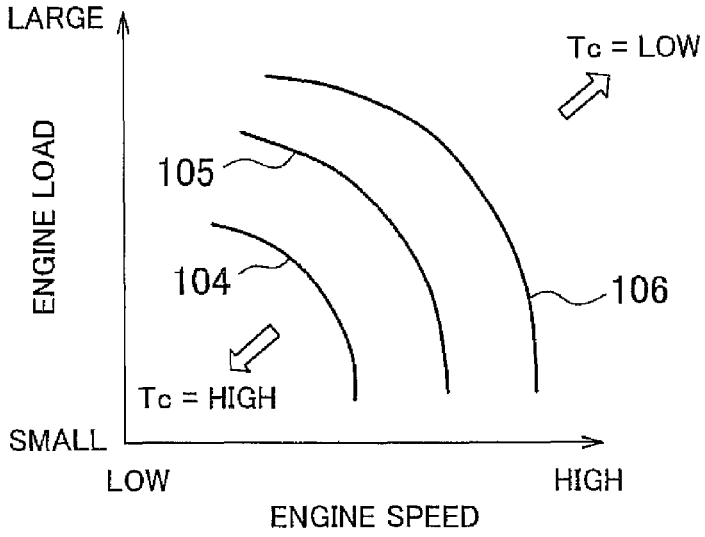
FIG. 8 is an example of a threshold map used in the control by the controller in the third example embodiment.

FIG. 8 is an example of the threshold map used for the control by the controller 60. The horizontal axis of the map represents the speed of the internal combustion engine 10, while the vertical axis represents the load on the internal combustion engine 10. Curves 104, 105, and 106 shown in FIG. 8 are level curves of the threshold (Tc). The temperatures of the curve 105 are higher than those of the curve 106, and the temperatures of the curve 104 are higher than those of the curve 105. The controller 60 extracts, from the map shown in FIG. 8, the value of the threshold (Tc), which corresponds to the engine load determined based on the result of detection by the engine load detection portion 70 and the engine speed determined based on the result of detection by the engine speed detection portion 71.

Figure 9:
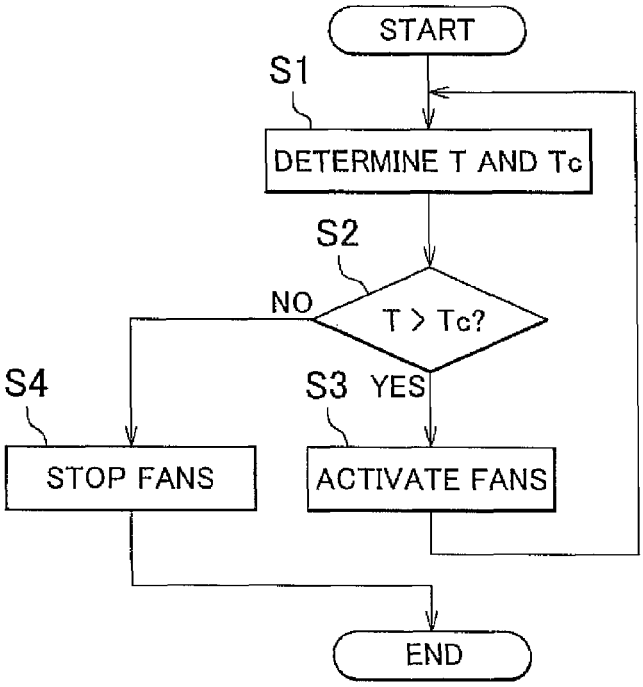
FIG. 9 is a flowchart illustrating an example control routine executed by the controller in the third example embodiment.

The flowchart of FIG. 9 illustrates, by way of example, a control routine executed by the controller 60. The controller 60 repeatedly executes the control routine at predetermined time intervals. Referring to FIG. 9, the controller 60 first determines the temperature (T) of the wall 23 and the value of the threshold (Tc) based on the operation state of the internal combustion engine 10 (step S1). More specifically, at this time, the controller 60 determines the temperature of the wall 23 by applying the load on the internal combustion engine 10, which has been determined based on the result of detection by the engine load detection portion 70, and the speed of the internal combustion engine 10, which has been determined based on the result of detection by the engine speed detection portion 71, to a map related to the temperature of the wall 23, and further the controller 60 determines the value of the threshold (Tc) by applying the engine load and the engine speed, which have been determined as described above, to the map for the threshold (Tc), which has been described earlier with reference to the example illustrated in FIG. 8.

Then, the controller 60 determines whether the temperature of the wall 23 is higher than the value of the threshold (Tc) (step S2). If it is determined in step S2 that the temperature of the wall 23 is higher than the threshold (Tc), the controller 60 then activates the fans 52 of the cooler 50*a* (step S3). It is to be noted that the controller 60 may be adapted to control the airflow by adjusting the speed of the fans 52 in accordance with the operation state of the internal combustion engine 10. In this case, for example, the controller 60 may control the speed of the fans 52 such that it is higher when the load on the internal combustion engine 10 is larger than a predetermined value and the speed of the internal combustion engine 10 is higher than a predetermined value, than when the load on the internal combustion engine 10 is not larger than the predetermined value and the speed of the internal combustion engine 10 is not higher than the predetermined value. After step S3, the controller 60 executes step S1 again.

In contrast, if it is not determined in step S2 that the temperature of the wall 23 is higher than the value of the threshold (Tc), the controller 60 then stops the fans 52 of the cooler 50*a* (step S4), after which the controller 60 finishes the control routine.

Thus, due to the porous portion 30, the cooler 50*a*, and the controller 60, the exhaust pipe 20*b* of the third example embodiment provides the effect that the temperature of the wall 23 can be more accurately controlled, as well as the effects of the first and second example embodiments. More specifically, the exhaust pipe 20*b* is capable of controlling the temperature of the wall 23 to be equal to or lower than the activation temperature of the catalyst 40, and thus is capable of making the temperature of the catalyst 40 closer to the activation temperature.

While the cooler 50*a* in the third example embodiment is an air-cooled cooler, coolers of various other types may attentively be used. For example, the cooler 50*a* may be a water-cooled cooler. In this case, for example, the controller 60 is adapted to control the temperature of the wall 23 by controlling a pump for delivering the coolant for the cooler 50, a flowrate control valve for controlling the flowrate of the coolant, and so on. More specifically, if it is determined in step S2 in the control routine illustrated in FIG. 9 that the temperature of the wall 23 is higher than the value of the threshold (Tc), the controller 60 controls, in step S3, the pump, the flowrate control valve, and so on, to make the coolant in the coolant passage 51 start flowing. In contrast, if it is not determined in step S2 that the temperature of the wall 23 is higher than the value of the threshold (Tc), the controller 60 controls, in step S4, the pump, the flowrate control valve, and so on, to stop the flow of the coolant in the coolant passage 51.

Next, an exhaust pipe of the fourth example embodiment of the invention (will hereinafter be referred to as "exhaust pipe 20*c*") will be described. The exhaust pipe 20*c* of the fourth example embodiment is different from the exhaust pipes of the first to third example embodiments in that the average size of the pores of the porous portion 30 is equal to or smaller than the mean free path of air. Other structural features are the same as those in the first to third example embodiments, and therefore their descriptions will be omitted.

Figure 10A:
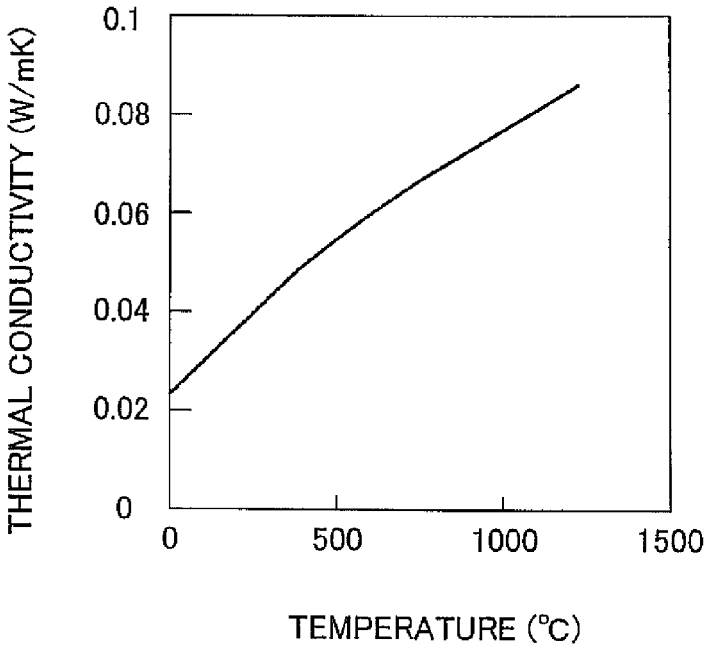
FIG. 10A is a graph illustrating how the thermal conductivity of air changes depending upon its temperature.

The graph of FIG. 10A illustrates how the thermal conductivity of air changes depending upon its temperature. In the graph, the horizontal axis represents the air temperature (° C.) and the vertical axis represents the thermal conductivity (W/mK) of air at a pressure of 0.1 MPa. Referring to FIG. 10A, it is found that the higher the temperature of air, the higher its thermal conductivity. As the reason of this, it is believed that heat travels also due to collisions between the molecules of air, and the higher the temperature of air, the more the molecules of air collide with each other, that is, the thermal conductivity of air increases as its temperature rises.

Figure 10B:
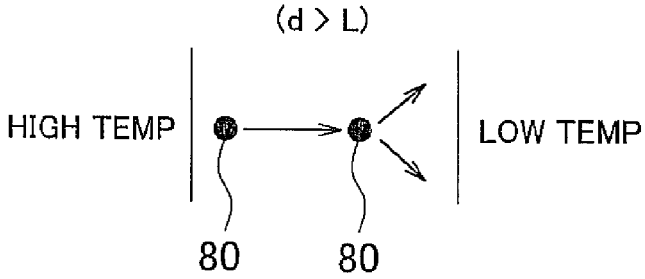
FIG. 10B is a chart for illustrating a relation between air and the mean free path of air.

The chart of FIG. 10B illustrates a relation between air and the mean free path of air. FIG. 10B schematically shows, by way of example, a state where a molecule 80 at a high temperature side collides with another molecule 80 at a low temperature side. If the average size (d) of the pores of the porous portion 30 is larger than the mean free path (L) of air, heat conductions due to collisions between the molecules 80 of air tend to occur. For this reason, in a case where the average size of the pores of the porous portion 30 is larger than the mean free path of air, when the exhaust gas temperature is high, the thermal conductivity of the air in the pores of the porous portion 30 may become large enough for the thermal conductivity of the porous portion 30 to be larger than estimated. More specifically, for example, in a case where the thermal conductivity of the porous portion 30 is estimated to be 0.1 W/mK or less, if the exhaust gas temperature becomes high, the thermal conductivity of the porous portion 30 may become equal to or higher than the thermal conductivity of air and exceed 0.1 W/mK.

According to the exhaust pipe 20*c* of the fourth example embodiment, in contrast, the average size of the pores of the porous portion 30 is equal to or smaller than the mean free path of air, and therefore it is possible to suppress the heat conductions that may be caused by collisions between the molecules 80 of the air in the pores of the porous portion 30. As such, the exhaust pipe 20*c* of the fourth example embodiment provides the effect that the thermal conductivity of the porous portion 30 can be restricted from becoming higher than estimated, as well as the effects of the first to third example embodiments.

The invention has been described with reference to the example embodiments for illustrative purposes only. It should be understood that the description is not intended to be exhaustive or to limit form of the invention and that the invention may be adapted for use in other systems and applications. The scope of the invention embraces various modifications and equivalent arrangements that may be conceived by one skilled in the art.

What is claimed is:

1. An exhaust pipe through which an exhaust port of an internal combustion engine and a catalyst for purifying an exhaust gas of the internal combustion engine are connected to each other, comprising:

a porous portion that is provided on at least a part of an inner peripheral face of the exhaust pipe, wherein a thermal conductivity that the porous portion exhibits in a high temperature state where a temperature of the exhaust gas is as high as it is required to radiate a heat of the exhaust gas through the exhaust pipe is at least ten times higher than a thermal conductivity that the porous portion exhibits in a low temperature state where the temperature of the exhaust gas is as low as it is required to warm the catalyst up.

2. The exhaust pipe according to claim 1, wherein a porosity of the porous portion is set such that the thermal conductivity of the porous portion in the high temperature state is at least ten times higher than the thermal conductivity of the porous portion in the low temperature state.

3. The exhaust pipe according to claim 1, wherein a cooler that cools a portion, at which the porous portion is provided, of a wall of the exhaust pipe is provided.

4. The exhaust pipe according to claim 3, wherein a controller that controls the cooler based on a temperature of the wall is provided.

5. The exhaust pipe according to claim 4, wherein the controller controls the cooler so as to bring the temperature of the wall to an activation temperature of the catalyst or lower.

6. The exhaust pipe according to claim 1, wherein an average size of pores of the porous position is equal to or smaller than a mean free path of air.

7. The exhaust pipe according to claim 1, wherein the porous portion is provided near or in proximity of the catalyst.

8. The exhaust pipe according to claim 1, wherein the porous portion is provided so as not to occupy a radially center portion of an interior of the exhaust pipe.

9. An exhaust pipe through which an exhaust port of an internal combustion engine and a catalyst for purifying an exhaust gas of the internal combustion engine are connected to each other, comprising:

a porous portion that is provided on at least a part of an inner peripheral face of the exhaust pipe, wherein a thermal conductivity that the porous portion exhibits when a temperature of the catalyst is close to an upper limit temperature of the catalyst is at least ten times higher than a thermal conductivity that the porous portion exhibits when the temperature of the catalyst is lower than an activation temperature of the catalyst.

10. The exhaust pipe according to claim 9, wherein a porosity of the porous portion is 85% or more.

11. The exhaust pipe according to claim 9, wherein the porous portion is made of amorphous material.

12. The exhaust pipe according to claim 11, wherein the amorphous material is amorphous silica.

* * * * *